US007197982B2

(12) United States Patent
Biggs

(10) Patent No.: US 7,197,982 B2
(45) Date of Patent: Apr. 3, 2007

(54) METHOD FOR DETECTION OF MEDIA LAYER BY A PENETRATING WEAPON AND RELATED APPARATUS AND SYSTEMS

(75) Inventor: Bradley M. Biggs, Plymouth, MN (US)

(73) Assignee: Alliant Techsystems Inc., Edina, MN (US)

( * ) Notice: Subject to any disclaimer, the term of this patent is extended or adjusted under 35 U.S.C. 154(b) by 25 days.

(21) Appl. No.: 11/147,980

(22) Filed: Jun. 8, 2005

(65) Prior Publication Data

US 2006/0090662 A1 May 4, 2006

Related U.S. Application Data

(60) Provisional application No. 60/578,466, filed on Jun. 9, 2004.

(51) Int. Cl.
*F42C 1/00* (2006.01)
*F42C 7/00* (2006.01)

(52) U.S. Cl. ..... 102/215

(58) Field of Classification Search ..... 102/215
See application file for complete search history.

(56) References Cited

U.S. PATENT DOCUMENTS 2,999,179 A * 9/1961 Renato et al. ..... 313/146
3,653,324 A * 4/1972 Furlani et al. ..... 102/215
3,738,275 A 6/1973 Schwartz et al.
4,009,662 A * 3/1977 Riparbelli ..... 102/216
4,190,000 A * 2/1980 Shaull et al. ..... 102/427
4,345,124 A * 8/1982 Abbin et al. ..... 200/61.53
4,375,192 A 3/1983 Yates et al.
4,638,130 A * 1/1987 Grossler et al. ..... 200/61.45 R (Continued)

FOREIGN PATENT DOCUMENTS

DE 3524130 A1 * 5/1990

(Continued)

OTHER PUBLICATIONS

GlobalSecurity.org, Guided Bomb Unit 24 (GBU-24) Paveway III, http://www.globalsecurity.org/military/systems/munitions/gbu-24.htm, visited May 17, 2005, 6 pages.

(Continued)

*Primary Examiner*—Michael J. Carone
*Assistant Examiner*—Bret Hayes
(74) *Attorney, Agent, or Firm*—TraskBritt

(57) ABSTRACT

The present invention is directed to a system and a method for accurately locating a penetrating-type weapon within a shelter for detonation at a desired target site. The method includes reliably and accurately detecting thin layers of a shelter by use of a weapon frequency induced by a vibration in a portion of the weapon. The weapon frequency is detected and at least one harmonic frequency of the weapon frequency is analyzed to determine whether a deceleration threshold event has occurred. In one embodiment, the harmonic frequency may be compared to a target frequency which is associated with the deceleration of the weapon during penetration of a layer of media. In another embodiment multiple weapon frequencies may be detected, analyzed, or compared to detect the penetration of a layer of media.

31 Claims, 6 Drawing Sheets

U.S. PATENT DOCUMENTS

| | | | | | |
|---|---|---|---|---|---|
| 4,667,598 | A | * | 5/1987 | Grobler et al. | 102/215 |
| 4,712,479 | A | * | 12/1987 | Babel | 102/427 |
| 4,727,809 | A | * | 3/1988 | Watson | 102/254 |
| 5,122,731 | A | | 6/1992 | Cole | |
| 5,255,608 | A | | 10/1993 | Min et al. | |
| 5,908,365 | A | * | 6/1999 | LaJaunie et al. | 175/4.56 |
| 6,105,505 | A | | 8/2000 | Jones | |
| 6,276,277 | B1 | | 8/2001 | Schmacker | |
| 6,378,435 | B1 | | 4/2002 | Bai et al. | |
| 6,469,639 | B2 | | 10/2002 | Tanenhaus et al. | |
| 6,483,323 | B1 | | 11/2002 | Bai et al. | |

FOREIGN PATENT DOCUMENTS

WO WO 03/051794 A2 6/2003

OTHER PUBLICATIONS

Picatinny, Fuzes, http://www.pica.army.mil/PicatinnyPublic/products_services/products19.asp, visited May 17, 2005, 4 pages.

* cited by examiner

METHOD FOR DETECTION OF MEDIA LAYER BY A PENETRATING WEAPON AND RELATED APPARATUS AND SYSTEMS

CROSS-REFERENCE TO RELATED APPLICATIONS

Related Applications: This application claims the benefit of U.S. Provisional Patent Application Ser. No. 60/578,466, filed Jun. 9, 2004, for MEDIA DETECTING USING AT LEAST ONE WEAPON FREQUENCY the disclosure of which is incorporated by reference herein in its entirety.

BACKGROUND OF THE INVENTION

1. Field of the Invention

The present invention generally relates to weapons and artillery and, more particularly, to penetrating type weapons that may be used, for example, to detect media layers in an effort to locate and destroy sheltered targets.

2. State of the Art

In military operations, targets may be generally classified as either unsheltered targets or sheltered targets. Unsheltered targets may be considered to include targets that are substantially exposed and vulnerable to a weapon or projectile fired by artillery directed at such targets. For example, people, munitions, buildings and other fighting equipment that are openly located on a battle field and substantially exposed to the weapons of an enemy attack may be considered unsheltered targets.

However, many targets including, for example, people, munitions, chemicals, and fighting equipment may be sheltered in order to protect them from an attack by various weapons. Conventionally, a shelter for a target includes a physical barrier placed between the target and the location of origin of an expected enemy weapon in an attempt to frustrate the weapon directed at the target and mitigate the damage that might otherwise be inflicted by such a weapon. In some cases targets may be heavily sheltered in an attempt to prevent any damage to a given target. In one example, one or more layers of concrete, rock, soil, or other solid material may be used in an effort to protect a desired target. Each layer may be several feet thick, depending on the level of protection desired. Sometimes these layers are referred to as "hard" layers indicating a relative amount of resistance that they will impose on an impending weapon. Generally, a layer is considered to be "hard" when it exhibits a specified level of thickness, when it is formed of a material exhibiting a specified level of hardness or some other material characteristic which significantly impedes penetration of a weapon, or when the layer exhibits a desired combination of material properties and physical thickness.

More specific examples of shelters for targets include a building, a room in a building, a bunker, a room in a bunker, or a room or a bunker located beneath a building. Considering a bunker as an example, the ceiling of a bunker may be configured as a hard layer in order to protect people, things, or a combination thereof, from non-penetrating weapons. Additionally, multiple hard layers may be used to shelter a target. Voids may be present between multiple layers for structural reasons or for purposes of trying to confuse existing weaponry designed to defeat such shelters by causing premature detonation.

In order to penetrate shelters, and particularly a hard layer (or layers) of a given shelter, a weapon system configured with a penetrator system is conventionally used. The general goal of using a penetrator system is to breach the shelter, including any thick layers that may be present, and deliver the weapon to a desired location (i.e., proximate the intended target) while delaying detonation of the weapon until it is at the desired location. Thus, use of a penetrator system enables a more efficient and a more effective infliction of damage to a sheltered target and, sometimes, use of a such a system is the only way of inflicting damage to certain sheltered targets.

A penetrator system is part of a weapon system which may include one or more warheads, a penetrator structure (generally referred to as a penetrator) and a sensor associated with and coupled to the penetrator. The penetrator may be configured to act as a warhead, or it may be a separate component, but generally includes a mass of relatively dense material. In general, the capability of a penetrator to penetrate a given layer of media is proportional to its sectional density, meaning its weight divided by its cross-sectional area taken along a plane substantially transverse to its intended direction of travel. The weapon system may include equipment for guiding the weapon to a target or, at least to the shelter, since, in many cases, forces associated with impact and penetration of a shelter may result in the removal of such equipment from the penetrator portion of the weapon. The sensor of a penetrator system is conventionally configured to assist in tracking the location of the penetrator as it penetrates layers of one media type or another after an initial impact of the penetrator with the shelter.

Various prior art penetrator systems have been employed with some degree of success. In some prior art penetrator systems, a sensor is used to detect an initial impact with a structure. The system then monitors the amount of time that has lapsed subsequent the detected impact in an effort to keep track of the location of a penetrator, based on calculated or estimated velocity of the weapon, as the penetrator penetrates a shelter. Such systems are sometimes referred to as time-delay systems.

Other prior art penetrator systems utilize sensors, such as an accelerometer, to measure the deceleration of the penetrator. The system then tracks the distance traveled by the weapon, from the time of the initial impact with a layer of a shelter or structure, in an effort to determine the weapon's location within the shelter or structure. These systems are generally referred to as penetration depth systems.

Some prior art penetrator systems utilize an accelerometer to detect deceleration of relatively hard and/or thick layers in an effort to help count the layers of media, count voids between the layers of media, or count both media layers and voids so as to determine the weapon's location within a particular structure.

Such prior art penetrator systems provide an output signal for detonating the weapon after the penetrator system has determined that the penetrating weapon has arrived at a desired location within the shelter. Desirably, the detonation of the weapon occurs at a target site such as within a specified room of a bunker. However, in practice, any of a number of factors may result in the miscalculation of a penetrating weapon's location within a shelter and, therefore, detonation of the weapon at an undesired location. Such factors may include, for example, variability in the physical or material characteristics of a given layer.

One particular issue faced by prior art penetrator systems includes the ability to detect so-called thin layers. While penetrator systems have been used to detect decelerations that result from the presence of a relatively thick or hard layer, such penetrator systems have not been effective in accurately detecting layers that are thin, soft, or some combination thereof, due to the relatively low amount of deceleration experienced by the penetrating weapon when passing through such thin or soft layers. Some examples of "thin" layers include ceilings and floors in buildings that may be located over a target. Some examples of "soft" layers include layers of sand or other soft soil. Generally, a layer is too thin or too soft to detect when the deceleration of a penetrating weapon, as it passes through such a layer, cannot be discerned from electrical noise, mechanical noise, or a combination of electrical and mechanical noise experienced by the sensor.

Some prior art systems have utilized gain switching in an effort to detect relatively thin layers. Gain switching generally includes use of a high gain amplifier to detect low levels of deceleration by the penetrating weapon and use of a lower gain amplifier as deceleration of the penetrating weapon increases. Such gain switching may occur between a computer sampling of the penetrating weapon's deceleration. Gain switching may generally be accomplished using one or more amplifiers, one or more analog-to-digital converters, or some combination thereof.

Nevertheless, such systems have not been effective in detecting layers that are as thin as those exhibited in numerous targets such as the thin roofs and floors of many buildings. Reducing noise in a sensor can help to increase the sensitivity of penetrator systems employing gain switching; however, reducing noise still does not provide the level of sensitivity needed to ensure that all layers, regardless of how thin, are detected.

Some prior art penetrating systems have actually attempted to avoid detection of thin layers so that the attendant errors in detecting soft or thin layers do not confuse the system and result in the untimely detonation of the penetrating weapon. For example, some attempts have been made to adjust the sensor thresholds of a penetrator system so that they only detect so-called "hard" layers and effectively ignore all thin or soft layers of a shelter. However, such attempts unfortunately result in the sensor ignoring a layer that is significant to a well-timed detonation such as, for example, the ceiling of a bunker, again resulting in the detonation of the penetrating weapon at an undesired location.

In other prior art penetrator systems, attempts have been made to not only ignore thin layers, but to prevent the system from erroneously counting a single layer as more than one layer. To do so, such penetrator systems have used a programmed distance, sometimes referred to as a "blanking distance," to ignore both false layers and real layers after the penetrator system has detected a deceleration of the weapon. In one example, a prior art penetrator system would calculate and measure the blanking distance traveled by the penetrator system based on the penetration velocity of the penetrator system at the time of its impact with a layer and the time that expired after such impact. Some other penetrator systems have also used the deceleration values and the detection of an exit of the penetrating weapon from a penetrated layer to help determine the blanking distance.

However, accurate detection and recognition of soft and thin layers is desirable in many applications, and simply ignoring such layers does not ensure detonation of the penetrating weapon at the desired location. As such, there is a continued desire to improve the penetrator systems used in weapons so as to increase their accuracy in determining their arrival at a desired location, including the detection of soft or thin layers, and thereby ensure a maximization of damage inflicted on a desired target. It would be desirable to provide such improvements through simple implementations so, for example, existing prior art systems may be updated and retrofitted in a simple and inexpensive manner.

BRIEF SUMMARY OF THE INVENTION

The present invention is directed to a system and a method for accurately locating a penetrating-type weapon within a shelter for detonation at a desired target site including the ability to accurately detect each layer of a shelter.

In accordance with one aspect of the invention, a method of locating a penetrating-type weapon within a shelter is provided. The method includes projecting the weapon through at least one layer of media and detecting at least one weapon frequency induced by vibration of at least a portion of the weapon. The harmonic frequency of the at least one weapon frequency is analyzed to determine, for example, whether a deceleration event has occurred. Detection of at least one weapon frequency may include detection of multiple weapon frequencies. Analysis of the harmonic frequency of the at least one weapon frequency may include determining whether an amplitude of the harmonic frequency meets or exceeds a defined minimum amplitude.

In accordance with another aspect of the present invention, a method of operating a weapon is provided. The method includes launching the weapon at a sheltered target and penetrating at least a first layer of the sheltered target with the weapon. At least one weapon frequency induced by vibration of at least a portion of the weapon is detected and a harmonic frequency of the at least one weapon frequency is analyzed. A delayed detonation program is then executed which includes detonating the weapon.

In accordance with yet another aspect of the present invention, a weapon system is provided. The weapon system includes an explosive device having a penetrator structure. At least one sensor is configured to detect at least one weapon frequency induced by vibration of at least a portion of the weapon. A computer is in electrical communication with the at least one sensor and configured to analyze at least one harmonic frequency of the at least one weapon frequency.

In accordance with yet a further aspect of the present invention, another weapon system is provided. The weapon system includes an explosive device having a penetrator structure. At least one sensor is configured to detect at least one weapon frequency induced by vibration of at least a portion of the weapon. A bandpass filter is electrically coupled with the at least one sensor and configured to extract at least one harmonic frequency from the at least one weapon frequency. A computer is in electrical communication with the bandpass filter and configured to analyze the at least one harmonic frequency of the at least one weapon frequency.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
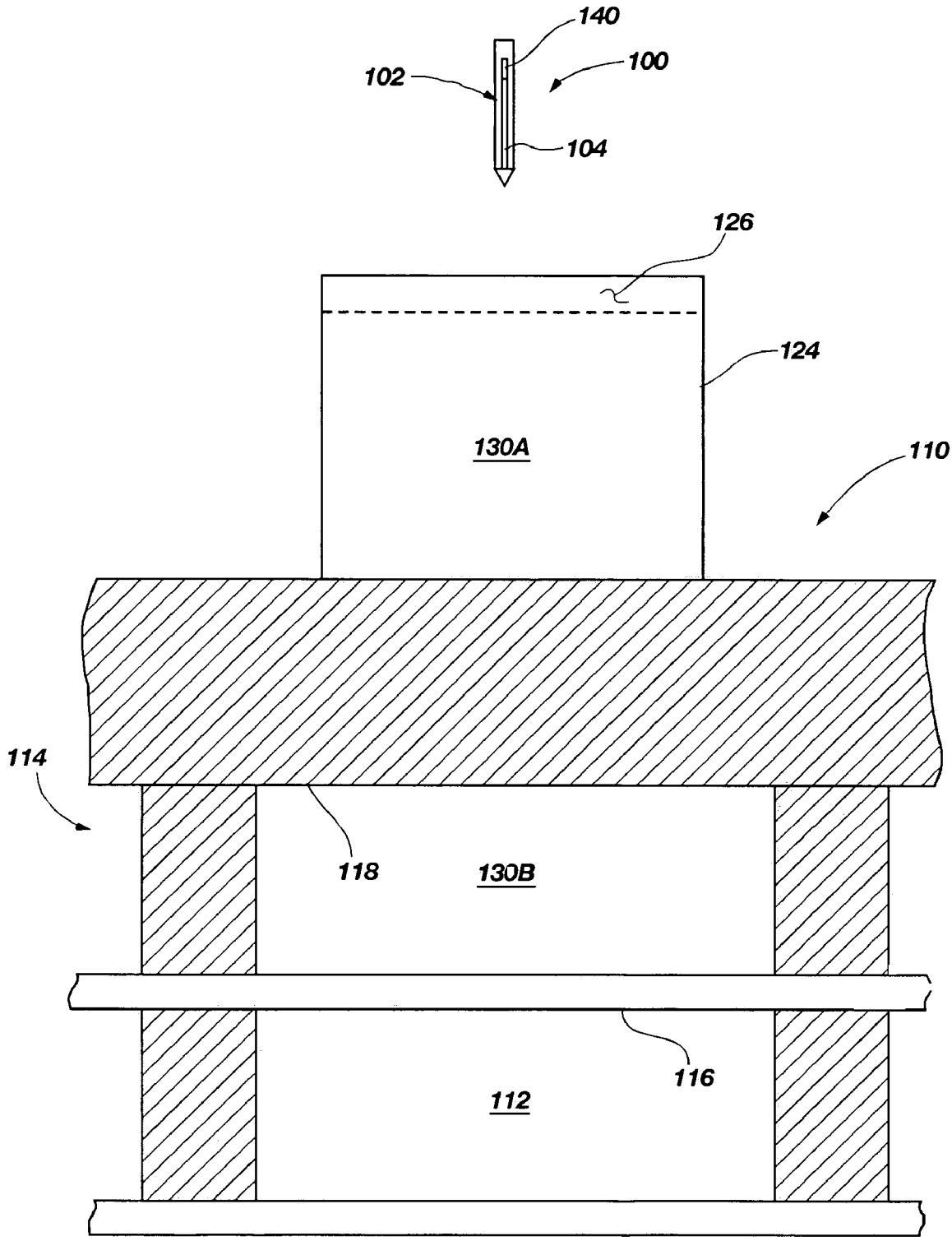
FIG. 1 is a schematic of a weapon having a penetrator system directed at a sheltered target in accordance with one embodiment of the invention.

Referring to FIG. 1, a weapon 100 is shown which includes a penetrator system 102. The penetrator system 102 may include a structural penetration component, referred to herein as a penetrator 104. The penetrator 104 may include a mass of relatively dense material. In general, the capability of a penetrator 104 to penetrate a given layer of media is proportional to its sectional density, meaning its weight divided by its cross-sectional area taken along a plane substantially transverse to its intended direction of travel. The penetrator system 102 also includes various electrical components, mechanical components, or both for detection of the layers of a shelter, for enablement of a delayed detonation program and firing of the weapon 100 as will be discussed in more detail hereinbelow. As will be appreciated by those of ordinary skill in the art, the weapon may include a single warhead or a plurality of warheads in any of a variety of configurations.

The weapon 100 is shown in FIG. 1 to be descending on a sheltered target 110. Generally, the sheltered target may include one or more layers or barriers. Such layers may be formed, for example, of sand, soil, limestone, granite, rock, concrete, or other media including a variety of man made structures. In one, more particular example, the intended target to be destroyed or damaged by the weapon 100 may include a room 112 inside a bunker 114. As discussed hereinabove, bunkers may be disposed below a layer of soil, a layer of hard or thick material, below a building or other structure, or some combination thereof. In the example shown in FIG. 1, the bunker 114 is shown to be located sequentially below a first layer, (referred to herein as the proximate layer 116 for convenience due to its proximity to the targeted room 112) such as the floor or ceiling or other structure within the bunker 114, a thick and hard layer of material such as reinforced concrete (referred to herein as a hard layer 118 for purposes of convenience), and a building 124. While the building 124 shown in FIG. 1 includes a roof 126 as a layer, it may include multiple layers including floors and ceilings associated with individual stories of the building.

Thus, in the example shown in FIG. 1, the weapon must traverse several layers (i.e., the roof 126, the hard layer 118 and the proximate layer 116) before arriving at the desired room 112 inside the bunker 114. It is noted that the proximate layer 116 may exhibit any of a various number of configurations (e.g., another hard layer, a thick layer, a soft layer, a thin layer, etc.).

The sheltered target 110 also includes voids such as areas or volumes between layers between discrete layers. Thus, for example, one void 130A exists between the roof 126 of the building 124 and the hard layer 118 and another void 130B exists between the hard layer 118 and the proximate layer 116. Additionally, the targeted room 112 inside the bunker may be configured as a void.

It is noted that the sheltered target 110 shown in FIG. 1 is merely an example and not limiting to the types and configurations of targets against which the present invention may be used. Those of ordinary skill in the art will appreciate that the sheltered target 110 may include additional layers, whether thick, thin, hard or soft, and additional voids. For example, a layer of soil may be disposed between the hard layer 118 and the building 124. Similarly, the "hard" layer 118 could simply be a thick layer (of relatively softer material than that described hereinabove), or it could be a soft or thin layer depending, for example, on the configuration of the other layers of the sheltered target 110.

In prior art penetrator systems, any of the sheltered target's layers, and particularly the thin layers, such as the roof 126, could be "missed" by the sensor of the penetrator system 102 or otherwise misread by the system resulting in the weapon detonating at an undesired location relative to the bunker room 112. However, the present invention includes the ability of the penetrator system 102 to reliably and accurately detect thin or soft layers and, therefore, more accurately determine the location of the weapon 100 within a structure or shelter as it continues towards the intended target.

Figure 2:
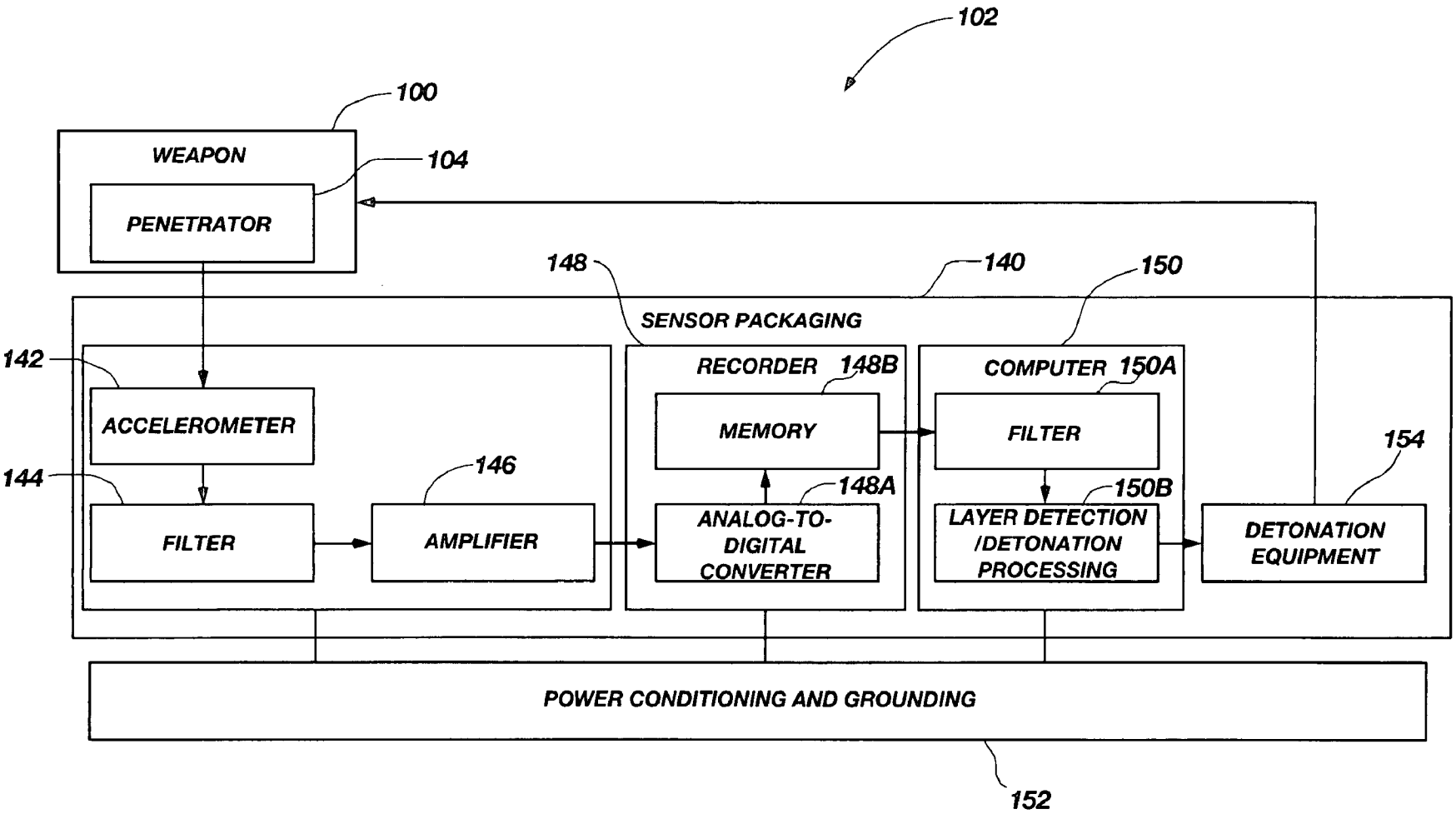
FIG. 2 is a block diagram of a penetrator system in accordance with an embodiment of the present invention.

Referring briefly to FIG. 2 in conjunction with FIG. 1, a block diagram is shown of a penetrator system 102 in accordance with one embodiment of the present invention. The penetrator system 102 may be configured to detect thin layers, soft layers or layers exhibiting both soft and thin characteristics.

The penetrator system 102 includes sensor packaging 140 that is coupled with the penetrator 104. The sensor packaging 140 may include structure for securing it to the penetrator 104 or some other portion of the weapon 100. For example, the sensor packaging 140 may include threaded structure for coupling with mating threads formed on or in the penetrator 104. Such a threaded configuration may also include a threaded lock ring and a locking plate as will be appreciated by those of ordinary skill in the art. In other embodiments, the sensor packaging 140 may be welded, bonded or otherwise fastened or joined with the penetrator 104 or weapon 100.

The sensor packaging 140 may further include, for example, at least one sensor such as an accelerometer 142, as well as a filter 144, an amplifier 146, a recording device 148, a computer or computer processor 150, power conditioning and grounding equipment 152, and detonation equipment 154 for detonating the weapon.

In the presently considered embodiment, the accelerometer 142, filter 144 and amplifier 146 may be configured such as in a hard target fuze (e.g., a FMU-159A/B fuze available from Alliant Techsystems Inc., of Edina, Minn.—sometimes referred to as a "hard target smart fuze") as will be appreciated by those of ordinary skill in the art. The accelerometer 142 is configured to measure the deceleration of the penetrator 104 imposed by the sheltered target 110 (or a layer thereof) and provides an analog signal, representative of the penetrator deceleration, to the amplifier 146 by way of the filter 144. The filter 144 may be configured to prevent aliasing of the analog signal when it is subsequently converted to a digital signal. The amplifier may include an application specific integrated circuit (ASIC) although other types of amplifiers may be used.

Figure 3:
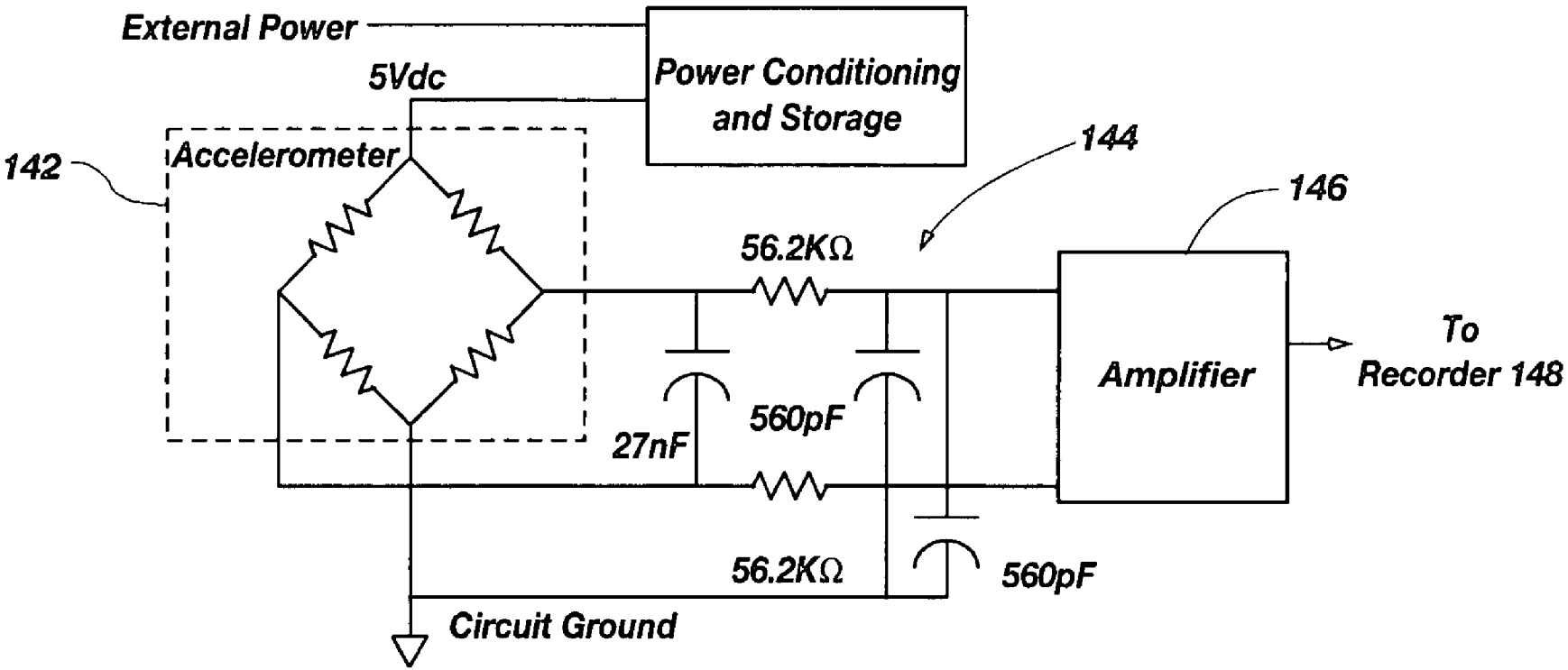
FIG. 3 is a schematic of a filter used in accordance with one embodiment of the present invention.

Referring briefly to FIG. 3, a schematic shows further detail of an example of a filter 144 coupled between an accelerometer 142 and an amplifier 146. It is noted that, while the example filter 144 shown in FIG. 3 depicts a specific arrangement of electrical components (e.g., resistors and capacitors), various other components and other arrangements of components may be used to provide an appropriate filter for the analog signal produced by the accelerometer 142.

Referring back to FIG. 2, the amplifier 146 amplifies the analog signal received from the filter 144 and provides the amplified signal to a recording device 148. The recording device 148 may include, for example, an analog-to-digital (A/D) converter 148A and a memory device 148B (or other data storage device or component).

The recording device 148 is connected to the computer 150 for processing and examining the digital signal that represents the detected penetrator deceleration in light of any data or other parameters programmed or stored in the computer 150. The computer 150 may include, for example, a digital signal processor, a field programmable gate array, a microcontroller such as is available, for example, from Motorola®, a PIC® type semiconductor available from Microchip Technology Inc., or other appropriately configured circuits. In one example, the computer 150 may be programmed or otherwise configured to provide a filtering process 150A and an analysis process 150B associated with detecting a deceleration event imposed on the weapon 100 by a layer of a shelter. For example, the filtering process 150A may include computer implemented bandpass filtering of the digital signal. Additionally, the analysis process 150B may include a processor configured to determine whether the filtered and amplified accelerometer signal, or data representative of the accelerometer signal, meets specified criteria indicative of the detection of a layer. Of course, individual components may be utilized to accomplish the filtering process 150A and the analysis process 150B.

The computer 150 may also be programmed or otherwise provided with mission data and a combination of parameters related to the intended target. For example, the computer 150 may be programmed with a delayed detonation program such that, upon detection of a deceleration event, the penetrator system 102 initiates the delayed detonation program. Such a delayed detonation program might include a time-delay program or a penetration depth program for detonating the weapon 100 at a desired location within a sheltered target 110. In another embodiment, the delayed detonation program might include the detection and counting of layers, voids or a combination of layers and voids prior to detonation of the weapon 100.

It is noted that the penetrator system 102 may be provided or programmed with the desired data and parameters during manufacture of the weapon 100 and penetrator system 102, at a time prior to launch, or even during delivery of the weapon 100 to its intended target. Such data may be provided to the penetrator system 102 through a wired connection or by wireless transmission.

The computer 150 is connected to the detonation equipment 154 which is explosively connected to the weapon 100, or at least one warhead of the weapon, for detonating the weapon 100 upon receipt of an appropriate signal from the computer 150. The detonating equipment may include, for example, a squib, a semiconductor bridge, or other mechanisms or components configured to ignite the explosive, incendiary or pyrotechnic material(s) contained by the weapon 100.

It is noted that the configuration shown in FIG. 2 is merely an example of one possible embodiment of the present invention and that various other configurations and arrangements may be used. For example, in one embodiment the filter 144 may be integrated into the amplifier 146. In another embodiment, the filter 144 may be placed after the amplifier 146 such that it processes the signal produced by the accelerometer 142 after amplification thereof. In some embodiments, the filter 144, the computer 150, or combination of the two components may include filtering for distinguishing deceleration experienced by the weapon 100, deceleration experienced by the penetrator 104 relative to that of the weapon 100, acceleration by either or both components, or any combination of such parameters.

Additionally, the accelerometer 142 may include, for example, a capacitive accelerometer, a resistive accelerometer, a micro electromechanical (MEM) accelerometer, or any combination of such accelerometers. Other sensors may also be used. Similarly, various types, or combinations, of filters, amplifiers, A/D converters, memory devices and computers may be used. In some embodiments, gain switching technologies may be used in conjunction with the present invention; however gain switching is not required in practicing the present invention.

Using a penetrator system 102 such as shown and described with respect to FIG. 2, the penetrator system 102 may be programmed to detonate the weapon 100 via the detonation equipment 154 upon the occurrence of a desired sequence of events. The computer 150 may, therefore, be programmed with appropriate software such as C++ or any other appropriate language including, for example, machine language, assembly language, a higher programming language or some combination thereof.

Figure 4:
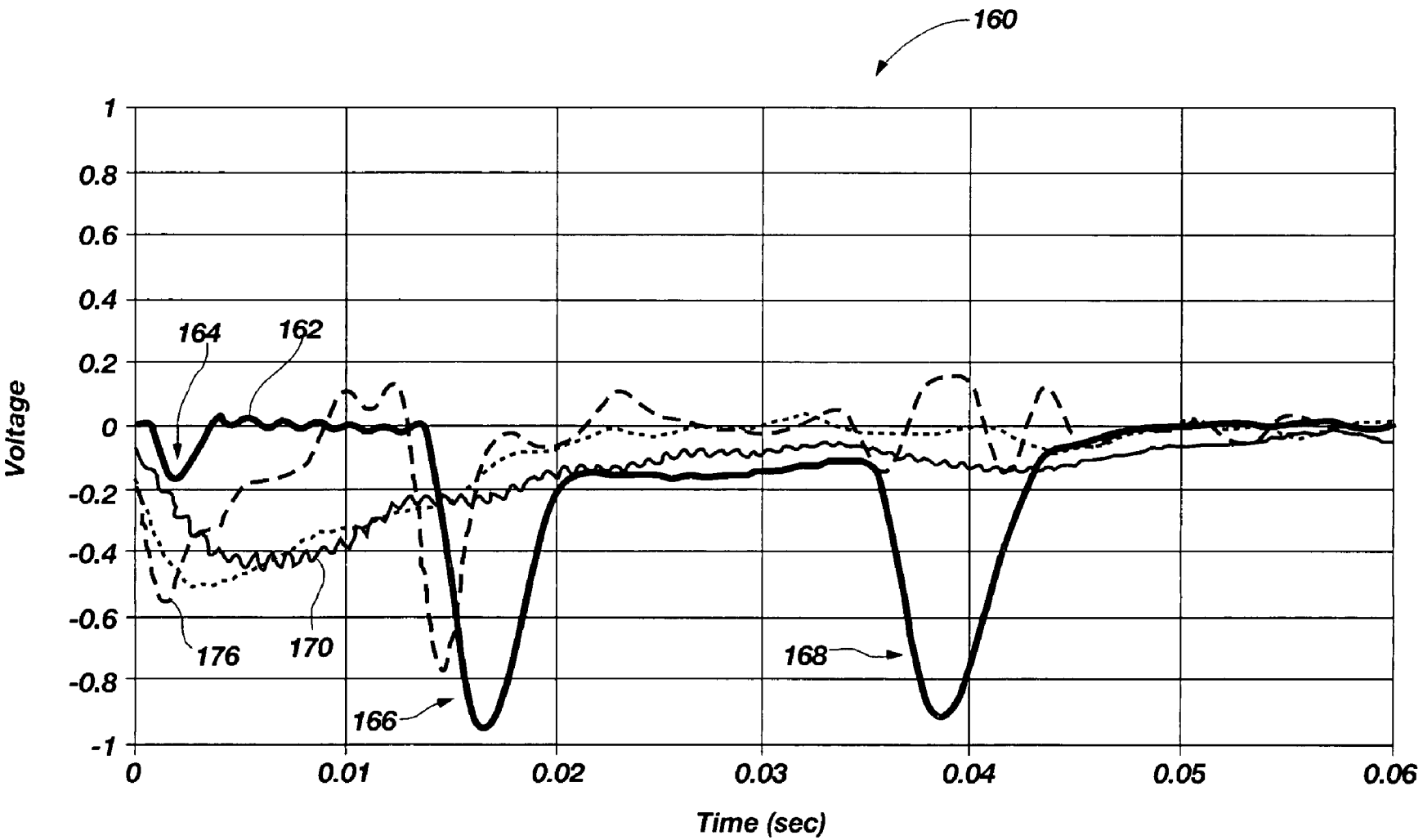
FIG. 4 is a graphical representation of the electrical output signals of a penetrator system in accordance with one aspect of the present invention.

Referring now to FIG. 4 in conjunction with FIGS. 1 and 2, operation of the weapon 100 and its associated penetrator system 102 is described with reference to the graph 160 depicting various signals obtained and processed by the penetrator system 102. FIG. 4 includes a plurality of superimposed plotlines including data representative of accelerometer data and various harmonic frequencies of a weapon's rigid body frequency.

Referring first to the plotline 162, a representation of the analog signal produced by the accelerometer 142 during penetration of various layers is shown. Thus, as shown at 164, a deceleration of the penetrator 102 and weapon 100 is shown to have occurred between 0 seconds and 0.01 seconds. Additionally, decelerations are indicated at 166 between 0.01 and 0.02 seconds and at 168 just prior to 0.04 seconds. The first deceleration event shown at 164 is relatively minor such that the voltage of the signal drops from 0 volts to somewhere between −0.1 volts and −0.2 volts. Such a change in the deceleration signal is small enough that prior art penetrator systems may not be able to recognize the change in the signal as being produced by the penetration of a layer and the attendant deceleration of the weapon 100.

The inability of prior art penetrator systems to recognize the signal at 164 as a deceleration event is due to the fact that, as the weapon 100 impacts and penetrates a given layer, two different types of vibrational frequencies are generated. One type of frequency may be referred to as a "target frequency" and is associated with the deceleration of the weapon 100 as it penetrates the layer. The other type of frequency may be referred to as a "weapon frequency" and is associated with vibration occurring within the weapon such as, for example, within the body of a warhead or at the interface between multiple components of the weapon (e.g., the interface between a penetrator 102 and sensor packaging 140). Such vibration within the weapon can include shock induced vibration.

Target frequency is, at least in part, a function of the thickness of the layer being penetrated by the weapon. Generally, target frequency increases as the thickness of a layer decreases. When a thin layer is impacted and penetrated by the weapon 100, target frequency is often near or equal to that of the weapon frequency making it difficult, if not impossible to discriminate one frequency from the other.

Thus, as discussed above, not being able to determine whether a detected signal was associated with a target frequency or a weapon frequency, many prior art penetrator systems would simply ignore the signal shown at 164 based on the fact that it does not meet a desired threshold (e.g., a change in the amplitude of the signal of, for example, 0.3 volts or greater).

In the present invention, the filtering process 150A of the computer is used to discern whether the signal at 164 is the result of the weapon impacting and penetrating a layer of a shelter, or whether it is simply being produced due to electrical noise, mechanical noise or some combination thereof. The filtering process 150A, which may include bandpass filtering, is configured to analyze one or more resonant frequencies of the weapon 100 while it is traversing layers and voids on its way to the intended target (e.g., room 112).

Figure 5:
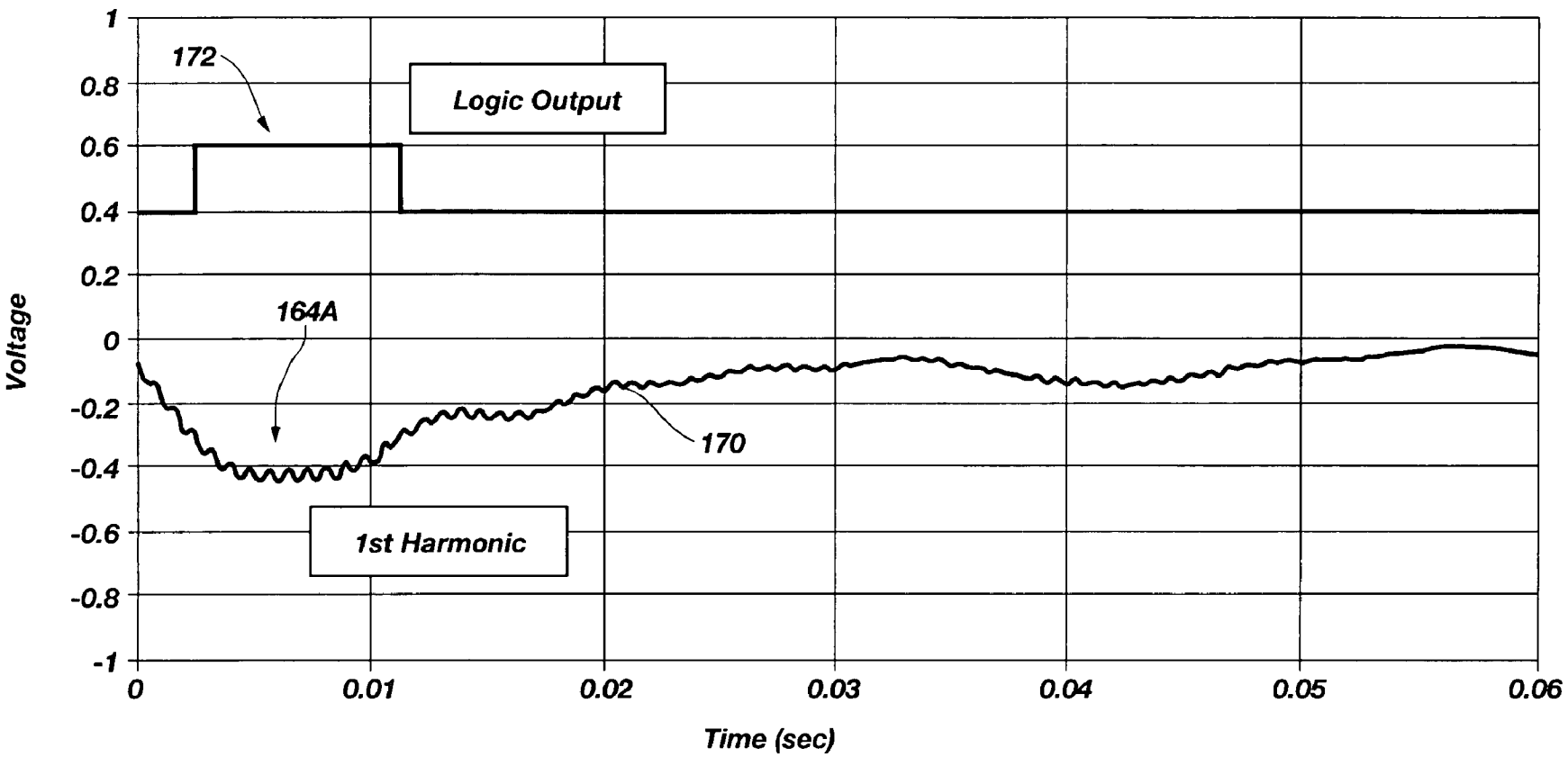
FIG. 5 is a graphical representation of the electrical output signals of a penetrator system in accordance with another aspect of the present invention.

For example, referring to FIG. 5 in conjunction with FIG. 4, a bandpass filter is used to analyze the first harmonic (e.g., plotline 170) of the weapon frequency in order to determine whether the signal located at 164 is a deceleration event or simply unwanted electrical or mechanical noise. As seen in FIG. 5 at location 164A, the signal associated with the first harmonic of the weapon frequency shows a significant change in amplitude during the time frame between 0 seconds and 0.01 seconds (e.g., a drop of more than 0.4 volts). In the present example, the analysis process 150B of the computer 150 (FIG. 2) would analyze whether such a change in signal met threshold requirements associated with a deceleration event. Considering, for example, a threshold change in the harmonic signal of 0.3 volts or greater to be associated with a deceleration event (e.g., impact and penetration of a layer of media), the first harmonic of the weapon frequency indicates that a layer has been impacted and penetrated by the weapon 100. In other words, detection of a minimum amplitude of the weapon frequency's harmonic indicates detection of a layer of media. Thus, on detection of such a minimum amplitude or threshold level, an appropriate output signal or state may be generated (or stored) by the computer 150 as indicated at point 172. Such an output signal or state may be used by the computer 150, for example, in initiating a time-delay or penetration depth program, or in counting layers or voids in an effort to properly locate the weapon 100 within a shelter.

Figure 6:
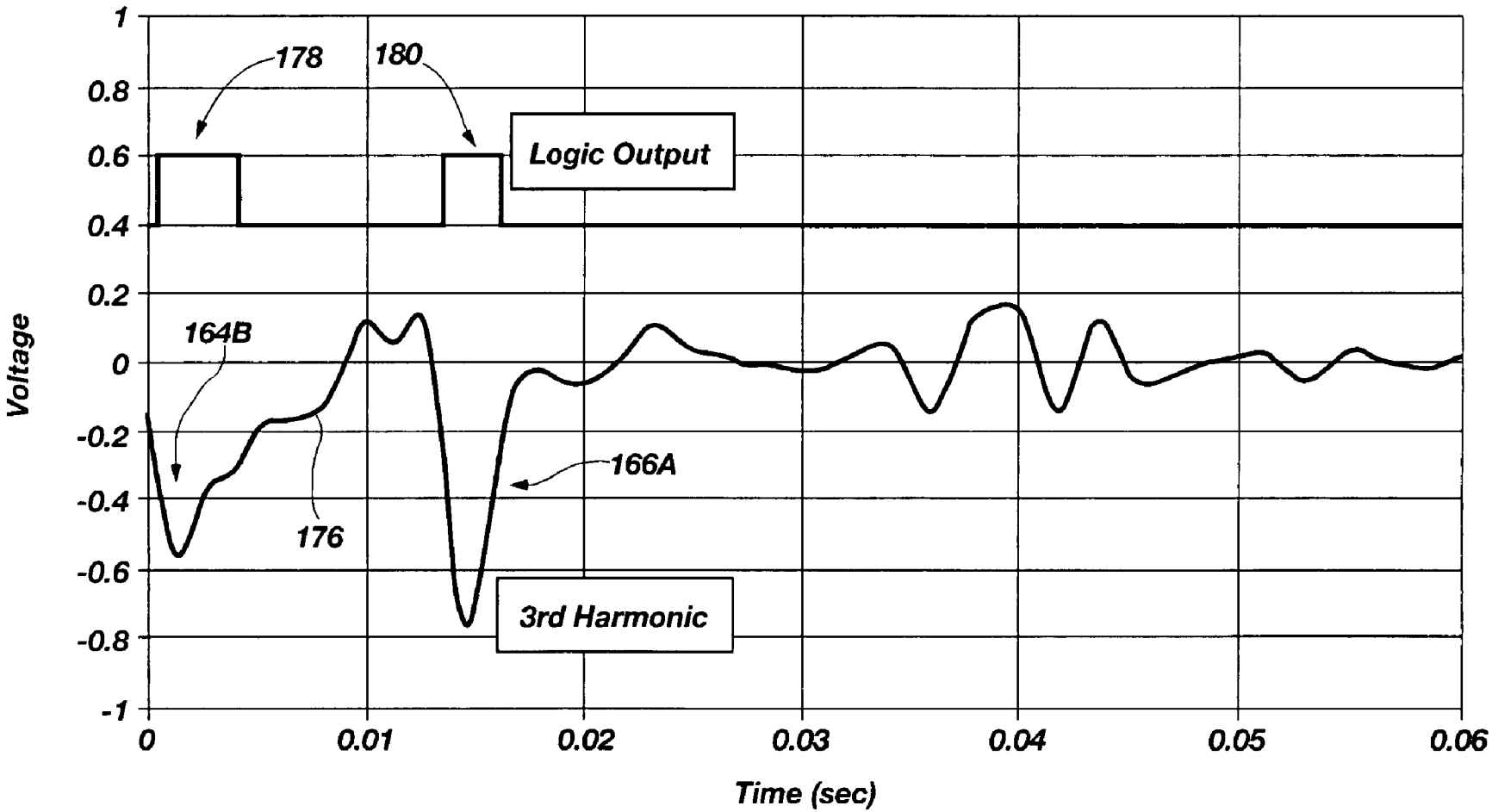
FIG. 6 is a graphical representation of the electrical output signals of a penetrator system in accordance with another aspect of the present invention.

Referring to FIG. 6 in conjunction with FIG. 4, filtering may be used to monitor the third harmonic (plotline 176) of the weapon frequency in a similar manner. Thus, as indicated at location 164B, the signal associated with the third harmonic of the weapon frequency shows a change of nearly 0.6 volts during the time frame of 0 seconds to 0.01 seconds. Thus, the third harmonic of the weapon frequency may be used to determine whether a deceleration event has occurred or it may be used to confirm such a deceleration event in conjunction with the first harmonic (or some other harmonic) of the weapon frequency. Again, upon detection of the minimum amplitude or threshold level an appropriate output signal or state may be generated (or stored) by the computer 150 as indicated at point 178.

Referring to FIGS. 4 through 6, it is noted that, in the present example, decelerations indicated at signal locations 166 and 168 do not necessarily need to resort to analysis of the weapon frequency's harmonics due to the large change in accelerometer signal (plotline 162) which clearly distinguishes the signal from potential electrical noise and mechanical noise. However, the harmonics of the weapon frequency may still be used in association with detecting, or confirming, the deceleration events represented by the graph at signal locations 166 and 168. For example, as shown in FIG. 6, the signal representative of the third harmonic of the weapon frequency (plotline 176) shows a substantial change in voltage at location 166A confirming the detection of a deceleration event. An appropriate output signal or state is again generated (or stored) by the computer 150 as indicated at point 180.

It is noted that, while the first and third harmonics are specifically used as examples in the present disclosure, the present invention may utilize other harmonics in detecting deceleration events.

Other embodiments, including the analysis of the harmonics of a weapon frequency are also contemplated. For example, rather than analyzing the harmonics of the weapon frequency to see if they meet a threshold amplitude, the computer 150 may be configured to analyze the ratio of the harmonics of the weapon frequency and the target frequency. Thus, for example, the computer may analyze the ratio of the signal shown at location 164 (plotline 162 in FIG. 4) and the signal of the first harmonic shown at location 164A (plotline 170 in FIGS. 4 and 5). The detection of a minimum ratio between such signals may be used to determine whether a deceleration event has occurred. Again, upon detection of a deceleration event, an appropriate output signal or state may be generated (or stored) by the computer as part of a programmed detonation sequence.

In another embodiment, the computer 150 may analyze the ratio of the multiple harmonics of the weapon frequency (e.g., a ratio of the first harmonic and the third harmonic). Again, the detection of a minimum ratio may be used to determine whether a deceleration event has occurred. In yet other embodiments, multiple weapon frequencies may be used (e.g., frequencies produced by different parts or portions of the weapon). For example, a first weapon frequency associated with vibration in a warhead body and a second weapon frequency associated with an interface between two of the weapon's components may be used. The harmonics of each of the weapon frequencies may be analyzed such that the analysis of one weapon frequency confirms the findings resulting from the analysis of the second weapon frequency. Other embodiments may include analysis of a ratio of the two frequencies in order to determine whether a minimum ratio has been detected.

Considering any of such embodiments, and referring to FIGS. 1 through 6, as a weapon 100 impacts the roof 126 of a building 124, a signal may be produced by the penetrator system 102 similar to that indicated at location 164. In prior art penetrator systems, the weapon would not likely detect that it had impacted the building 124 and, therefore, would fail to initialize a delayed detonation program such as a time-delay program, a penetration depth program or a layer/void counting program. However, by analyzing the harmonics of the weapon frequency, the penetrator system 102 of the present invention would detect impact of the weapon 100 with the roof 126 and properly initiate any such delayed detonation program.

Similarly, even though prior art penetrator systems might detect impact and penetration of the hard layer 118 (such a hard layer might, for example, produce a signal similar to that at signal location 166 of plotline 162), such systems would likely fail to detect subsequent thin layers such as, for example, the proximate layer 116 just above the room 112 targeted by the weapon 100. In contrast, the present invention would again detect such a layer by analyzing the harmonics of the weapon frequency. It is noted that, for example, if the weapon 100 was utilizing a media (or void) counting program as part of its detonation sequence, the present invention would provide an accurate detection and counting of the layers (or voids) while a prior art penetrator system would not.

With regard to the counting of layers, voids or both, the present invention may also assist in the detection of voids that immediately follow thin layers. The detection of a void occurs by detecting a relative acceleration that occurs in the weapon 100 and penetrator 104. Thus, analysis of the harmonics of a weapon frequency may be used to determine such a relative acceleration. For example, when the amplitude of a signal representing a harmonic frequency falls below a specified threshold, relative acceleration is being detected indicating the existence of a void.

It is noted that, in the examples set forth in the present disclosure, detection and analysis of the third harmonic of a weapon's rigid body frequency provides the best data to detect thin layers as is easily seen by comparing the plotline 170 (the first harmonic frequency) with plotline 174 (the second harmonic frequency) and plotline 176 (the third harmonic frequency) as shown in FIGS. 4 through 6. Particularly, plotline 176 provides significant changes in voltage which correspond to the leading edge of each of the first pulse in the accelerometer data 162 (i.e., the pulses or deceleration events indicated by the accelerometer data at 164 and 166, respectively), and significant changes in voltage which correspond with the leading and the trailing edges of the third pulse in the accelerometer data 162 (i.e., the pulse or deceleration event indicated at 168). However, other harmonic frequencies may be more applicable in different circumstances depending, for example, on the configuration of the weapon, the types of materials from which the weapon is constructed and other environmental conditions.

While the invention may be susceptible to various modifications and alternative forms, specific embodiments have been shown by way of example in the drawings and have been described in detail herein. For example, the present invention may include weapons having single or multiple warheads; the present invention may be used in reconnaissance equipment or other nonexplosive equipment; or the penetrator system may be configured to require multiple and varied events prior to detonation or otherwise activate the lethality of the weapon. Thus, it should be understood that the invention is not intended to be limited to the particular forms disclosed and the invention includes all modifications, equivalents, and alternatives falling within the spirit and scope of the invention as defined by the following appended claims.

What is claimed is:

1. A method of detecting a layer of media with a penetrating weapon, the method comprising:

projecting the weapon through at least one layer of media;

detecting at least one weapon frequency induced by vibration of at least a portion of the weapon; and analyzing a harmonic frequency of the at least one weapon frequency.

2. The method according to claim 1, wherein analyzing a harmonic frequency of the at least one weapon frequency further includes determining an amplitude of the harmonic frequency.

3. The method according to claim 2, wherein analyzing a harmonic frequency of the at least one weapon frequency further includes determining whether the amplitude of the harmonic frequency is greater than a specified minimum amplitude.

4. The method according to claim 1, wherein detecting at least one weapon frequency induced by vibration of at least a portion of the weapon further includes detecting a weapon frequency induced by a vibration in a body portion of the weapon.

5. The method according to claim 1, wherein detecting at least one weapon frequency induced by vibration of at least a portion of the weapon further includes detecting a weapon frequency induced by a vibration in an interface between two discrete components of the weapon.

6. The method according to claim 1, wherein detecting at least one weapon frequency induced by vibration of at least a portion of the weapon further includes detecting a first weapon frequency induced by a vibration in a first portion of the weapon and detecting a second weapon frequency induced by a vibration in a second portion of the weapon.

7. The method according to claim 6, wherein analyzing a harmonic frequency of the at least one weapon frequency includes analyzing a harmonic frequency of the first weapon frequency and analyzing a harmonic frequency of the second weapon frequency.

8. The method according to claim 7, further comprising determining a ratio of the harmonic of the first weapon frequency and the harmonic of the second weapon frequency.

9. The method according to claim 7, wherein analyzing a harmonic frequency of the at least one weapon frequency further includes determining an amplitude of the harmonic frequency of the first weapon frequency and determining the amplitude of the harmonic frequency of the second weapon frequency.

10. The method according to claim 9, wherein analyzing a harmonic frequency of the at least one weapon frequency further includes determining whether at least one of the amplitude of the harmonic frequency of the first weapon frequency and the amplitude of the harmonic frequency of the second weapon frequency is greater than a specified minimum amplitude.

11. The method according to claim 1, further comprising detecting at least one target frequency associated with a deceleration of the weapon as it traverses the at least one layer of media.

12. The method according to claim 11, further comprising determining a ratio of the harmonic frequency of the at least one weapon frequency and the at least one target frequency.

13. The method according to claim 12, further comprising determining a ratio of the harmonic of the at least one weapon frequency and the at least one target frequency.

14. A method of operating a weapon, the method comprising:

launching the weapon at a sheltered target;

penetrating at least a first layer of the sheltered target with the weapon;

detecting at least one weapon frequency induced by vibration of at least a portion of the weapon;

analyzing a harmonic frequency of the at least one weapon frequency; and executing a delayed detonation program including detonating the weapon.

15. The method according to claim 14, wherein analyzing a harmonic frequency of the at least one weapon frequency to determine whether a parameter of the harmonic frequency meets a specified threshold parameter further includes determining an amplitude of the harmonic frequency.

16. The method according to claim 14, wherein detecting at least one weapon frequency induced by vibration of at least a portion of the weapon further includes detecting a weapon frequency induced by a vibration in a body portion of the weapon.

17. The method according to claim 14, wherein detecting at least one weapon frequency induced by vibration of at least a portion of the weapon further includes detecting a weapon frequency induced by a vibration in an interface between two discrete components of the weapon.

18. The method according to claim 14, wherein detecting at least one weapon frequency induced by vibration of at least a portion of the weapon further includes detecting a first weapon frequency induced by a vibration in a first portion of the weapon and detecting a second weapon frequency induced by a vibration in a second portion of the weapon.

19. The method according to claim 18, wherein analyzing a harmonic frequency of the at least one weapon frequency includes analyzing a harmonic frequency of the first weapon frequency and analyzing a harmonic frequency of the second weapon frequency.

20. The method according to claim 18, further comprising determining a ratio of the harmonic of the first weapon frequency and the harmonic of the second weapon frequency.

21. The method according to claim 20, further comprising determining a ratio of the harmonic frequency of the at least one weapon frequency and the at least one target frequency.

22. The method according to claim 14, wherein executing the delayed detonation program further includes counting layers of media encountered by the weapon.

23. The method according to claim 22, wherein executing the delayed detonation program further includes counting voids between the layers of media encountered by the weapon.

24. A weapon system comprising:

an explosive device having a penetrator structure;

at least one sensor configured to detect at least one weapon frequency induced by vibration of at least a portion of the weapon system;

a computer in electrical communication with the at least one sensor and configured to analyze at least one harmonic frequency of the at least one weapon frequency.

25. The weapon system of claim 24, wherein the at least one sensor includes at least one of a capacitive accelerometer, a resistive accelerometer, and a micro electromechanical (MEM) accelerometer.

26. The weapon system of claim 24, wherein the computer is configured to filter a signal from at least one filter using bandpass filtering.

27. The weapon system of claim 26, further comprising an analog-to-digital converter disposed between and in electrical communication with the at least one sensor and the computer.

28. The weapon system of claim 27, further comprising an anti-aliasing filter disposed between and in electrical communication with the at least one sensor and the analog-to-digital converter.

29. The weapon system of claim 28, further comprising an amplifier disposed between and in electrical communication with the anti-aliasing filter and the analog-to-digital converter.

30. The weapon system of claim 24, further comprising a detonating mechanism in electrical communication with the computer and configured to detonate the explosive device.

31. A weapon system comprising:

an explosive device having a penetrator structure;

at least one sensor configured to detect at least one weapon frequency induced by vibration of at least a portion of the weapon system;

a bandpass filter electrically coupled with the at least one sensor configured to extract at least one harmonic frequency from the at least one weapon frequency; and a computer in electrical communication with the bandpass filter and configured to analyze the at least one harmonic frequency of the at least one weapon frequency.

* * * * *

UNITED STATES PATENT AND TRADEMARK OFFICE

CERTIFICATE OF CORRECTION

PATENT NO. : 7,197,982 B2
APPLICATION NO. : 11/147980
DATED : April 3, 2007
INVENTOR(S) : Bradley M. Biggs It is certified that error appears in the above-identified patent and that said Letters Patent is hereby corrected as shown below:

| | | | |
|---|---|---|---|
| CLAIM 13, | COLUMN 12, | LINES 46-48, | delete "**13**. The method according to claim **12**, further comprising determining a ratio of the harmonic of the at least one weapon frequency and the at least one target frequency." |
| CLAIM 14, | COLUMN 12, | LINE 49, | change "**14**. A method of operating a weapon," to --**13**. A method of operating a weapon,-- |
| CLAIM 15, | COLUMN 12, | LINE 61, | change "**15**. The method according to claim **14**," to --**14**. The method according to claim **13**,-- |
| CLAIM 16, | COLUMN 12, | LINE 66, | change "**16**. The method according to claim **14**," to --**15**. The method according to claim **13**,-- |
| CLAIM 17, | COLUMN 13, | LINE 4, | change "**17**. The method according to claim **14**," to --**16**. The method according to claim **13**,-- |
| CLAIM 18, | COLUMN 13, | LINE 9, | change "**18**. The method according to claim **14**," to --**17**. The method according to claim **13**,-- |
| CLAIM 19, | COLUMN 13, | LINE 16, | change "**19**. The method according to claim **18**," to --**18**. The method according to claim **17**,-- |
| CLAIM 20, | COLUMN 13, | LINE 21, | change "**20**. The method according to claim **18**," to --**19**. The method according to claim **17**,-- |
| CLAIM 20, | COLUMN 13, | LINE 25, | insert --**20**. The method according to claim **13**, further comprising detecting at least one target frequency associated with a deceleration of the weapon as it penetrates the first layer of the target.-- |

UNITED STATES PATENT AND TRADEMARK OFFICE

CERTIFICATE OF CORRECTION

PATENT NO. : 7,197,982 B2
APPLICATION NO. : 11/147980
DATED : April 3, 2007
INVENTOR(S) : Bradley M. Biggs It is certified that error appears in the above-identified patent and that said Letters Patent is hereby corrected as shown below:

CLAIM 22, COLUMN 13, LINE 28, change "claim 14," to --claim 13,--

Signed and Sealed this

Fourteenth Day of October, 2008

JON W. DUDAS
*Director of the United States Patent and Trademark Office*